US007943012B2

(12) United States Patent
Backman et al.

(10) Patent No.: US 7,943,012 B2
(45) Date of Patent: May 17, 2011

(54) PROTECTING DEVICE FOR SPRAYING EQUIPMENT AND METHOD OF PROTECTING IT AND ITS SURROUNDINGS

(75) Inventors: Hans-Erik Backman, Littoinen (FI); Don Cesario, Green Bay, WI (US); Bertil Eriksson, Karlstad (SE); Marko Hyensjö, Karlstad (SE); Ray Krumenacker, Buford, GA (US); Anders Lindén, Karlstad (SE); Heikki Luoma, Thunder Bay (CA); Per-Arne Nyman, Karlstad (SE); Robert Olsson, Forshaga (SE); Phil Ponka, Thunder Bay (CA); Mauri Puumala, Thunder Bay (CA); Ian Salo, Thunder Bay (CA)

(73) Assignee: Metso Paper, Inc., Helsinki (FI)

( * ) Notice: Subject to any disclaimer, the term of this patent is extended or adjusted under 35 U.S.C. 154(b) by 689 days.

(21) Appl. No.: 11/568,145

(22) PCT Filed: Apr. 6, 2005

(86) PCT No.: PCT/SE2005/000498

§ 371 (c)(1),
(2), (4) Date: Oct. 1, 2007

(87) PCT Pub. No.: WO2005/103380

PCT Pub. Date: Nov. 3, 2005

(65) Prior Publication Data

US 2008/0135196 A1 Jun. 12, 2008

(30) Foreign Application Priority Data

Apr. 20, 2004 (SE) ..... 0401007

(51) Int. Cl.
*D21G 3/00* (2006.01)

(52) U.S. Cl. ..... 162/272; 162/199

(58) Field of Classification Search ..... 162/199, 162/272; 427/421, 425, 426, 427, 458, 314; 118/325, 318, 314

See application file for complete search history.

(56) References Cited

U.S. PATENT DOCUMENTS

| | | | | |
|---|---|---|---|---|
| 5,633,044 | A * | 5/1997 | Linnonmaa | 427/424 |
| 5,849,321 | A | 12/1998 | Linnonmaa | |
| 6,063,449 | A | 5/2000 | Koskinen et al. | |
| 6,203,858 | B1 | 3/2001 | Plomer | |
| 6,248,407 | B1 * | 6/2001 | Hess | 427/480 |
| 6,494,954 | B1 * | 12/2002 | Bernert et al. | 118/314 |
| 6,503,325 | B1 * | 1/2003 | Hess | 118/325 |
| 6,627,261 | B1 * | 9/2003 | Vahakuopus et al. | 427/314 |

FOREIGN PATENT DOCUMENTS

WO WO 02/072953 A1 9/2002

* cited by examiner

*Primary Examiner* — Mark Halpern
(74) *Attorney, Agent, or Firm* — Alston & Bird LLP

(57) ABSTRACT

A device for protecting a spraying equipment and surroundings in a paper or board machine, for applying a treatment medium onto a moving surface, comprises a protecting cover forming a single chamber having the spraying equipment located therein and which is open towards the moving surface in connection with an application zone. Two wall elements of the protecting cover extend in the cross-machine direction on either side of the application zone, and define machine-wide gaps with the moving surface. The protecting cover includes a sealing arrangement arranged in connection with the gaps to control and restrict passage of air and contaminants through the gaps; a system for a controlled supply of capture air for capturing contaminants within the space; and an evacuating system for a controlled, continuous evacuation of the capture air with contaminants from the chamber. An associated method of using such a device is also provided.

37 Claims, 6 Drawing Sheets

PROTECTING DEVICE FOR SPRAYING EQUIPMENT AND METHOD OF PROTECTING IT AND ITS SURROUNDINGS

This application is a 371 of PCT/SE05/00498 filed on 6 Apr. 2005

BACKGROUND OF THE INVENTION

1. Field of the Invention

The present invention relates to a device for protecting a spraying equipment and the surroundings about the spraying equipment mounted in a paper or board machine in connection with a first moving surface of the machine in order to apply a treatment medium onto the first moving surface within a machine-wide application zone, said device comprising a machine-wide protecting cover arranged to enclose the spraying equipment and said application zone and having an internal space, which forms a single chamber in which the spraying equipment is located and which is open towards the first moving surface in connection with said application zone, said protecting cover comprising first and second, machine-wide wall elements, said wall elements extending cross to the machine direction on either side of said application zone, said first wall element being located upstream said application zone, as seen in relation to the direction of movement of the first moving surface onto which the treatment medium is applied, and defines a machine-wide, first gap between itself and the first moving surface, and the second wall element defines a machine-wide, second gap between itself and the first moving surface or a second moving surface.

The invention also relates to a method of protecting a spraying equipment and the surroundings about the spraying equipment mounted in a paper or board machine in connection with a first moving surface of the machine for applying a treatment medium onto the first moving surface within a machine-wide application zone, said application zone being enclosed by a protecting cover so that an internal space of the protecting cover, which space forms a single chamber in which the spraying equipment is located, is open towards the first moving surface so that a machine-wide, first wall element of the protecting cover is located upstream said application zone, as seen in relation to the direction of movement of the first moving surface onto which the treatment medium is applied, and defines a machine-wide, first gap between itself and the first moving surface, and a machine-wide, second wall element of the protecting cover defines a machine-wide, second gap between itself and the first moving surface or a second moving surface.

2. Description of Related Art

An adhesive and protecting coating is applied continuously on the shell surface of a drying cylinder, e.g. a Yankee cylinder, in a tissue machine by a spraying equipment, which includes a plurality of spray nozzles arranged for providing a continuous, machine-wide spray pattern on the shell surface in a position located before the transfer nip that is formed by the Yankee cylinder and a press roll. The spray nozzles emit a spraying liquid which is a mixture of water and special chemicals which are to form said coating. The purpose of the coating is to control the adhesion of the paper web against the Yankee cylinder and to protect the shell surface against wear as well as chemical attacks. The spraying liquid discharged from the spray nozzles has a high pressure, typically 3-5 bar, and hits the shell surface at a high velocity. A portion of the chemicals adheres in the desired way to the hot shell surface, which can have a temperature of e.g. 90-100° C. When the aqueous spraying mixture hits the hot shell surface, a mist is created which contains vapor and non-evaporated water from the spraying liquid, but also residues of chemicals which are not attaching to the shell surface or do not reach the shell surface for some reason, e.g. as a result of the spraying liquid being influenced in an undesired way by lateral forces from the boundary layer air flows which are created along the shell surface as a result of the high speed of rotation of the Yankee cylinder. The chemical-containing mist is carried away from the place of application by local air streams which mainly are produced by the fast production of said water vapor, by convection, by said boundary layer air flows along the shell surface, and by air streams along a clothing running around the adjacent press roll, e.g. a felt or wire running around a suction press roll. The local air streams created in this way and bringing the chemical-containing mist with them, are difficult to control and they can spread out into the surroundings both in the dry end of the tissue machine as well as outside of it, with accompanying problems. Dust from cellulose fibers being released from the paper web and brought along by the surrounding air streams is accumulated in different places of the paper machine. A portion of the chemical-containing mist can get into contact with such dust-coated places, whereby the adhesive chemicals easily adhere to and form a mix with the dust. Furthermore, before the mist reaches these dust-coated places, it can intermix with cellulose fibers occurring in surrounding air streams, when said local air streams get into contact with and intermix with the surrounding air streams. These accumulations of a mixture of said chemicals and dust of cellulose fibers constitute an increased risk of fire with resulting production stops and loss of production, and increase the maintenance costs for cleaning the tissue machine. Furthermore, the chemical-containing air streams can escape from the machine, where the chemicals can be a risk to the machine operators, e.g. undesired inhalation of the chemicals and an annoying or hazardous accumulation of the chemicals on e.g. floor surfaces, so that the floors become slippery and the accumulation has an influence on the environment. There are similar problems also in other places of the described machine and in other paper machines as well as board machines, where a spraying equipment is arranged in connection with a moving surface onto which a coating is applied.

U.S. Pat. No. 6,248,407 describes applicators for applying an atomized coating agent onto a paper web by a spray nozzle. In one embodiment, the applicator comprises a housing having a chamber in which the spray nozzle is located. Steam is supplied to the chamber continuously for creating and maintaining a humid atmosphere inside the chamber in order to prevent the droplets and particles of the coating agent from drying on their way towards the web, thereby maintaining a low viscosity of the coating agent, so that the produced coating attains a smooth surface. Any excess of treatment liquid is drained through an outlet from the chamber. The housing with its chamber for maintaining a humid atmosphere is thus an integral part of the applicator itself. The patent neither describes nor indicates the problems ensuing from a spraying equipment and its surroundings, as discussed above, but is exclusively about creating a humid atmosphere for the coating agent in its application stage.

U.S. Pat. No. 6,203,858 describes applicators for coating a web with a coating agent which first is applied onto a roll encountering the web. The applicators include a spray nozzle and a vacuum chamber enclosing the spray nozzle and possibly an additional chamber. In the latter case the inlet side of the vacuum chamber is closed by a mechanical scraping device. In the first case, i.e. without said additional chamber, the vacuum chamber forms gaps at its inlet and outlet sides through which air is sucked into the vacuum chamber. Via a special internal gap formed by a baffle plate surplus spray mist is sucked into the vacuum chamber and out of it via an outlet, while coating agent attaching onto the insides of the vacuum chamber runs down therefrom and is drawn off through a special outlet in order to be recovered. The fact that air flows into the vacuum chamber both at the inlet side and at the outlet side indicates that a rotation at a low speed is concerned when applying chemicals onto the roll in order to form a coating which subsequently is to be transferred to the web, and that no special measures have been made or disclosed in order to seal the vacuum chamber in relation to the coating-transferring roll, neither in connection therewith for providing and maintaining a controlled supply and removal of air and through-flow of air in the vacuum chamber in connection with the more difficult operating conditions prevailing in a high speed machine. Neither does the patent touch upon the above-discussed problems concerning an unprotected spraying equipment at a hot Yankee cylinder and the environment surrounding it, especially when high speed machines are concerned.

The object of the present invention is to reduce the above-mentioned problems essentially and to create conditions for an improved hygiene both inside and outside the paper or board machine, a reduced fire hazard in the dry end of the paper or board machine as a result of accumulation of dust, such as fibers and fiber parts, and chemicals on the machine stands, an improved working environment for the operating staff and, in addition, an improved efficiency when applying the coating onto a cylinder surface or a supported paper or board web.

BRIEF SUMMARY OF THE INVENTION

The device according to the invention is characterized in that the protecting cover comprises:

- a sealing arrangement arranged in connection with said gaps for restricting at least essentially passage of air and contaminants through the gaps in a controlled manner;
- a system for a controlled supply of capture air for capturing contaminants occurring within the space; and
- an evacuating system for a controlled, continuous evacuation of the capture air with contaminants from the said single chamber through which the capture air is flowing.

The method according to the invention is characterized by the following steps:

- sealing the protecting cover while using a sealing arrangement in connection with said gaps in order to restrict at least essentially passage of air and contaminants through the gaps in a controlled manner;
- supplying capture air in a controlled manner in order to capture contaminants occurring within the space; and
- continuous and controlled evacuating of the capture air with contaminants from the said single chamber through which the capture air is flowing.

The expression "contaminants" primarily relates to residues of spraying liquid, such as chemicals, vapor, water particles, but also dust particles, primarily constituting fibers and fiber parts which have been torn loose from the web and which are captured by air streams of which small quantities, under certain circumstances, can follow the moving web into the protecting cover.

BRIEF DESCRIPTION OF THE SEVERAL VIEWS OF THE DRAWING(S)

The invention will be described further in the following with reference to the drawings.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
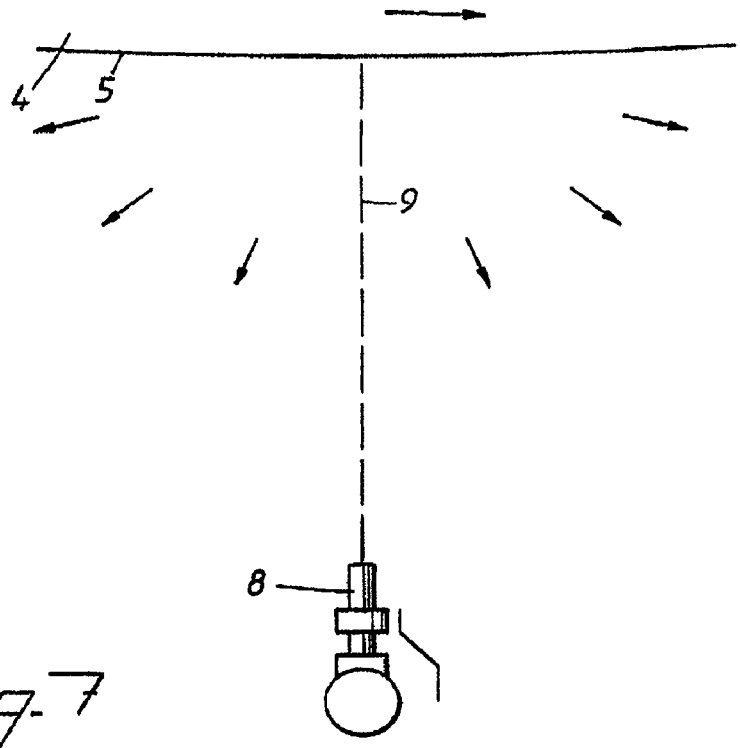
Fig. 1 Prior Art
FIG. 1 shows schematically a spraying equipment and portions of a drying cylinder, where the application of an adhesive protective coating takes place according to prior art without taking any consideration for the environment.

FIG. 1 shows a machine-wide spraying equipment 8, which is arranged in connection with a shell surface 5 of a drying cylinder 4, and which discharges a jet 9 of chemical-containing spraying liquid for applying an adhesive and protecting coating onto an exposed portion of the shell surface 5. FIG. 1 illustrates the above-discussed prior art, wherein the arrows being directed obliquely downwards illustrate a mist consisting of residues of spraying liquid, primarily in the form of an excess of chemicals and water in vapor form and liquid form, said mist causing some of the above-mentioned problems.

Figure 2:
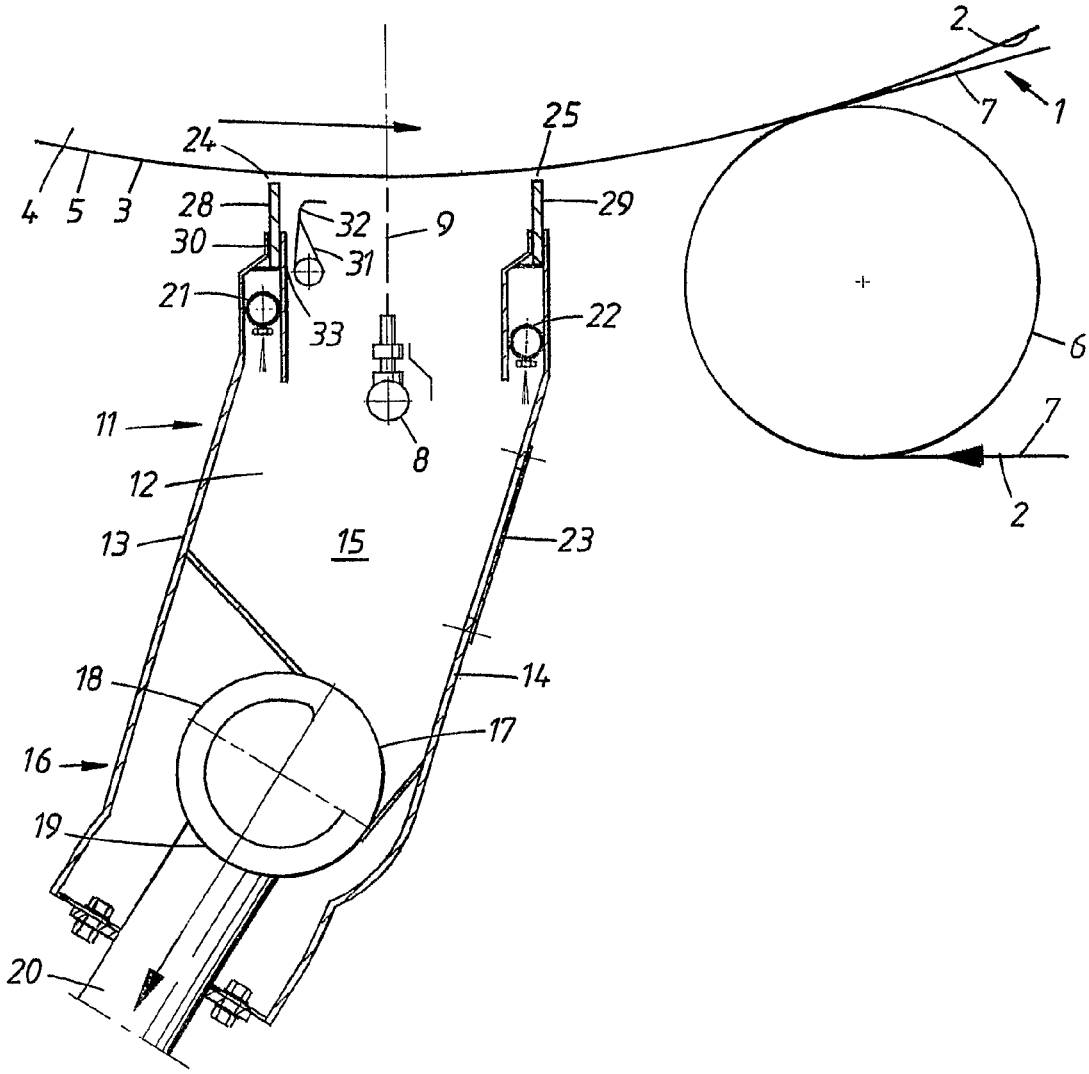
FIG. 2 shows schematically portions of a drying section of a paper machine being equipped with a protecting device according to a first embodiment of the invention.
Figure 3:
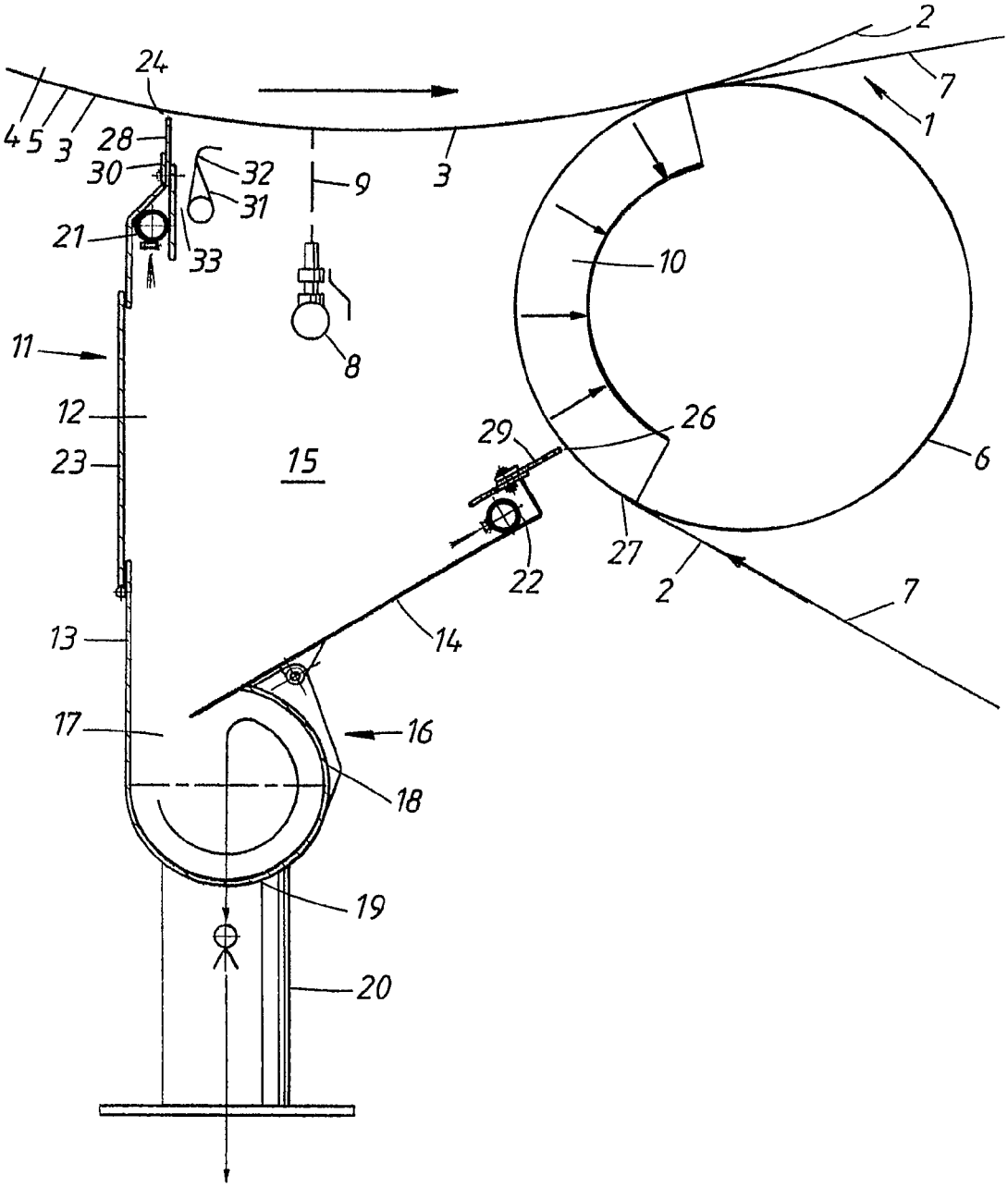
FIGS. 3, 4 and 5 show schematically portions of a drying section of a paper machine being equipped with a protecting device according to a second embodiment of the invention, the three Figures showing different alternatives for aligning the spraying equipment.

FIGS. 2 and 3 show schematically portions of a section 1 of a paper or board machine being operated at a high speed for manufacturing a web 2, e.g. a paper machine for manufacturing a web of soft paper such as tissue and other hygiene paper products, said section 1 having a first moving surface 3. Such a moving surface generally can be formed by the web 2 per se, a shell surface of a smooth roll, etc. In FIGS. 2 and 3, the section 1 is constituted of a drying section including a rotating drying cylinder 4 covered by a hood (not shown) and having a shell surface 5 which is exposed within a portion in order to form said moving surface 3 which is to be treated. In the indicated example (i.e. a tissue machine), conveniently the drying cylinder 4 is a Yankee cylinder. A roll 6 is arranged for interacting with the drying cylinder 4 in order to form a transferring nip, in which the web 2 is transferred to the hot, cylindrical shell surface 5 of the drying cylinder 4 from a clothing 7 which runs in a loop between a section (not shown) being located upstream and the drying section 1 in which it is running around the roll 6. The web 2 is carried by the clothing 7 in contact with its outside up to the transferring nip. From the transferring nip, the web 2 is running in contact with the hot shell surface 5 of the drying cylinder 4 in order to be dried to a predetermined dry content. At the outlet side of the drying section, a creping doctor (not shown) is arranged in connection with the shell surface 5 of the drying cylinder for creping loose the dried web 2 from the shell surface 5. Furthermore, the drying section 1 is provided with a machine-wide spraying equipment 8 for discharging a jet 9 of a treatment medium in the form of a chemical-containing spraying liquid in order to apply an adhesive and protecting coating onto the shell surface 5 of the drying cylinder 4 in connection with said exposed portion of the shell surface which is obtained after having creped loose the dried web 2, said exposed portion extending up to said transferring nip and forming said moving surface 3. Before the spraying equipment 8, as seen in the direction of rotation of the drying cylinder 4, there can be one or several cleaning doctors (not shown) for leveling out residues of the previously applied coating. The spraying equipment 8 is thus arranged in a place that is located between such a possible cleaning doctor and the roll 6. The spraying equipment 8 comprises a plurality of nozzles, overlapping each other, and a spray bar carrying the nozzles.

In the drying section 1 according to FIG. 2, the roll 6 is a smooth, non-perforated press roll, and the clothing 7 transfers the web 2 from a drying device (not shown) being located upstream. Alternatively, the roll 6 can be a shoe press roll.

In the drying section 1 according to FIG. 3, the roll 6 is a suction press roll and the clothing 7 is a felt or wire which transfers the web 2 from a section (not shown) being located upstream. The suction press roll 6 has a suction zone 10 which encloses a predetermined sector angle, typically about 120°, and being located entirely or at least mainly upstream the transferring nip.

The drying sections 1 being shown in FIGS. 2 and 3 are equipped with a specific protecting device for the spraying equipment 8 and its surroundings, said protecting device comprising a machine-wide protecting hood 11 which is arranged to enclose the spraying equipment 8 and the jet 9 of spraying liquid being discharged therefrom and directed towards the moving surface 3 of the drying cylinder 4 within a machine-wide application zone which is thus located within said exposed portion, i.e. the moving surface 3, of the shell surface 5. The protecting cover 11 is thus entirely open in a direction towards the moving surface 3 of the drying cylinder and has an internal unitary, i.e. undivided, space 12, which thereby forms a single chamber within which the spraying equipment 8 is located. The space 12 is defined by first and second, machine-wide wall elements 13, 14 and two side wall elements 15 which connect the machine-wide elements 13, 14 (the front side wall element is removed in the shown embodiments in order to expose the inside of the protecting cover). The two side wall elements 15 are thus extending in the machine direction, whereas the machine-wide wall elements 13, 14 are extending cross to the machine direction on either side of the application zone. The first wall element 13 is located upstream the application zone, as seen in relation to the direction of movement of the moving surface 3 onto which the treatment medium is applied. The wall elements 13, 14 and the side wall elements 15 are enclosing the spraying equipment 8 completely in order to protect it in its entirety also from dust-carrying air streams occurring inside the machine. As mentioned above the space 12 is unitary, i.e. undivided, which means that the space 12 forms a single, functional chamber. Accordingly, the space 12 is not divided into two chambers, for instance, by any partition, e.g. by such a portion that extends between the machine wide wall elements in connection to the spraying equipment so that this is located in both of said chambers which are communicating with each other. In other words, the unitary space 12 is free from chamber-defining elements which impede a free through-flow of air from the air inlet of the space to the air outlet thereof. The said single chamber thus admits free passage for the air so that this air is allowed to flow freely through the chamber from the air inlet to the air outlet thereof.

Furthermore, the protecting device comprises a system for a controlled supply of capture air for capturing contaminants occurring in the space 12, as well as an evacuating system for a controlled, continuous evacuation of a mixture of the capture air, residues of spraying liquid, and supplied water, which has been used for internal cleaning, out from the space 12 of the protecting cover 11. The evacuating system comprises an outlet portion 16 which is a part of the protecting cover 11 and located at a distance from and radially outside the spraying equipment 8, as seen in relation to the drying cylinder 4. The outlet portion 16 comprises a horizontal, machine-wide outlet pipe 18 which communicates with said space 12 of the protecting cover 11 via a machine-wide, continuous outlet gap 17 and having at one of its ends an outlet opening 19 facing downwardly and opening into a downwardly-directed outlet pipe 20. Suitably, the outlet pipe 18 has a circular shape in order to obtain an advantageous Venturi effect in a direction towards the outlet opening 19.

The protecting cover 11 is provided with an inspection opening 23, which can be suspended from a hinge joint. In the embodiment according to FIG. 2, the inspection opening 23 is arranged in the second wall element 14, whereas the inspection opening 23 in the embodiment according to FIG. 3 is arranged in the first wall element 13. As is evident from FIG. 3, the second wall element 14 is pivotally arranged around a hinge so that the wall element 14 can be lowered in order to provide an additional possibility of getting access to the internal space 12 for maintenance and cleaning when this is required.

In the embodiments being shown in FIGS. 2 and 3, a spray pipe 21 is arranged on the inside of the first wall element 13 in order to create an ejector action by its discharged liquid jets along and towards said inside in a direction towards the outlet gap 17. The discharged liquid jets also have a cleaning effect in that they remove any accumulations of contaminants from the inside of the wall element 13, but also a protecting effect in that they prevent contaminants from getting into contact with and attaching to the inside. Furthermore, the discharged liquid has a cooling effect on the vapor in said residues of spraying jets so that the vapor is condensed. The cooling effect can be increased by lowering the temperature of the liquid being discharged from the spray pipe 21. A similar spray pipe 22 for providing said ejector action, cleaning effect, protecting effect and cooling effect is arranged on the inside of the second wall element 14 of the protecting device according to FIGS. 2 and 3.

In the embodiments according to FIGS. 2 and 3, the first wall element 13 defines a machine-wide, first gap 24 between itself and the moving surface 3. In the embodiment according to FIG. 2, the second wall element 14 defines a machine-wide, second gap 25 between itself and said moving surface 3, whereas in the embodiment according to FIG. 3 a machine-wide, second gap 26 is defined by the second wall element 14 and a second moving surface 27, as will be described in greater detail below. As used herein, the expression "first gap" refers to the gap which is located at the inlet side of the protecting cover 11, i.e. the side where the moving surface 3 runs into the protecting cover or, in other words, the gap which is located upstream the application zone, as seen in relation to the direction of movement of the moving surface 3.

Furthermore, the protecting device comprises a sealing arrangement which is arranged in connection with said gaps 24, 25; 26 in order to restrict passage of air and contaminants through the gaps in a controlled manner. The sealing arrangement thus decreases essentially the possibility that residues of spraying liquid escape through the gaps, but also prevents large quantities of air from flowing in towards the application place and the spraying equipment onto which dust particles present in the in-flowing air can deposit. On the other hand, the restricting function of the sealing arrangement on the passage of air and contaminants implies that a predetermined quantity of air is allowed to enter through at least the first gap 24 in FIGS. 2 and 3 in order to be guided through the protecting cover 11 and carry the residues of spraying liquid with it in a direction towards the evacuating system without interfering with the spraying process, said predetermined quantity of air containing dust particles in an amount which is so small that the risk of larger deposits on the spraying equipment is negligible, especially since the capture air flowing through the space 12, now containing residues of spraying liquid and a small quantity of dust particles, will get into contact with the spraying equipment to a very small extent, but will be handled by the cooperating evacuating system in a controlled efficient way so that the through-flowing air is guided away from the spray equipment. The said air of predetermined amount, that forms said air through-flowing in the space 12, is according to the invention denoted capture air. In the embodiments according to FIGS. 2 and 3, for each gap 24, 25; 26 and wall element 13, 14, the sealing arrangement comprises a machine-wide, mechanical sealing device in the form of a sealing strip 28 and 29, respectively, wherein each wall element 13, 14 comprises a holder 30 for carrying the sealing strip 28, 29 thus defining said gap 24, 25; 26 between itself and the moving surface 3 (FIG. 2) or the moving surfaces 3, 27 (FIG. 3) by its free surface. The sealing strip 28, 29 can consist of a suitable plastic or rubber material and is suitably detachably mounted in the holder 30 in order to be easy to replace with a corresponding or a different sealing strip with respect to the size in order to provide the same or another size of the gap, respectively. Alternatively, the sealing strip 28, 29 is adjustable in relation to the moving surface 3 or the moving surfaces 3, 27 in order to enable a simple and rapid adjustment of the size of the gap 24, 25; 26 according to each requirement. The gap 24 that is located at the first wall element 13 is adjusted by the sealing strip 28 in order to restrict passage of air and contaminants, said restriction allowing the passage of a determined quantity of capture air into the protecting cover 11 in order to operate the evacuation of residues of spraying liquid therein. In certain cases, if desired, the sealing strip 28 can be removed in order to increase the size of the gap 24. The drying cylinder 4 is rotating at a high speed, so that a boundary layer air flow is created along the shell surface 5. In operation, a radial inner layer of this boundary layer air flow will be brought into the protecting cover 11 through the gap 24 in order to form said capture air, whereas the remaining part, being a main part, of the boundary layer air flow hits the wall element 13 and is diverted along its outside away from the protecting cover 11 without disturbing the spraying process. Thus, said inner layer is to form said determined quantity of capture air which is to be allowed to penetrate into the protecting cover 11, wherein an air barrier is created which prevents residues of spraying liquid from escaping through the gap 24. The gap 24 has a size which is within the range of 1-75 mm, preferably 25-30 mm. A machine-wide deflector 31 is arranged inside the space 12 of the protecting cover 11 in the vicinity of the holder 30 for the sealing strip 28, i.e. in a position between the gap 24 and the spray pipe 21. The deflector 31 comprises a plate 32, extending along the holder 30 of the first wall element 13 in order to form a narrow channel 33 therebetween having an inlet opening facing the drying cylinder 4, and an outlet opening facing the outlet portion 16 of the protecting cover 11 and being located just behind the spray pipe 21. At its upper portion, the plate 32 is bent in a direction away from the gap 24 in order to form an edge portion, thus being directed towards the spraying liquid 9, and a tapering shape of the inlet opening. The ejector action created by the liquid jets from the spray pipe 21 will result in a pressure reduction in the narrow deflector channel 33, so that a portion of the air being introduced through the gap 24 and a portion of the residues of spraying liquid being thrown off from the application place are sucked into the inlet opening of the deflector channel 33 and through the deflector channel 33 in order to be passed on towards the outlet portion 16 of the protecting cover 11. Suitably, the deflector 31 is arranged pivotally in order to be rotated into a position in which it is blocking the path for the jet of spraying liquid 9 when, for some reason, it is desired temporarily to interrupt the application onto the moving surface 3.

In the embodiment according to FIG. 2, the protecting cover 11 is arranged at a distance from the roll 6. This means that the shell surface of the drying cylinder 4 is exposed and visible after the protecting cover 11 and up to the transferring nip. The gap 25 that is located at the second wall element 14 is adjusted by the sealing strip 29 so that the gap 25 becomes as small as possible, but without the sealing strip 29 coming in contact with the moving surface 3 and its coating, in order to minimize emissions of residues of spraying liquid into the environment, i.e. to restrict passage of air and contaminants through the gap 25. The gap 25 has a size which is within the range of 1-50 mm, preferably 25-30 mm, and which usually is smaller than the size of the gap 24. In this embodiment, the evacuating system comprises a fan and separating arrangement (not shown) to which the protecting cover 11 is connected via its outlet pipe 20. The fan and separating arrangement includes a fan, which is arranged for creating a negative pressure inside the protecting cover 11, and a separating device for separating water.

In the embodiment according to FIG. 3, the protecting cover 11 is arranged for enclosing also a portion of the suction press roll 6. In this case, the gap 26 is defined by the sealing strip 29 of the second wall element 14 and the suction press roll 6 or, more specifically, the web 2 running around the suction press roll 6 together with the clothing 7 and which forms said second moving surface 27. In the same way as the first gap 24, which is located at the first wall element 13, said second gap 26 is adjustable by its sealing strip 29 in order to allow passage of a fixed quantity of air into the protecting cover 11. The gap 26 has a size which is within the range of 1-50 mm, preferably 25-30 mm. Also in this case, because of the high machine speed, a boundary layer air flow is created along the second moving surface 27, i.e. the web 2. In operation, a radial inner layer of this air flow will be brought into the protecting cover 11 through the gap 26, whereas the remaining part, being a main part, of the air flow hits the wall element 14 and is diverted along its outside away from the protecting cover 11 without disturbing the spraying process. Thus, said inner layer is to form a proportion of said fixed quantity of capture air which is to be allowed to penetrate into the protecting cover, whereby an air barrier is created, preventing residues of spraying liquid from escaping through the gap 26. The second wall element 14 is arranged for enclosing a portion of the circumference of the suction press roll 6 which is so large that at least its suction zone 10 becomes enclosed within the space 12 of the protecting cover 11. A proportion of the air being introduced through the gap 26 follows along the web 2 in order to be partially sucked into the suction press roll 6. The capture air being introduced into the protecting cover 11 through the two gaps 24 and 26 creates a positive pressure inside the upper portion of the space 12 of the protecting cover. This positive pressure can be utilized for transporting away the capture air with its content of residues of spraying liquid from within the protecting cover via the cooperating evacuating system. In this way, it is possible to dispense with a fan system and to use only a separating system for handling water and chemicals dissolved or dispersed therein which are removed from the protecting cover 11. If a fan system needs to be used, this can be made smaller and cheaper than the fan system being used at the protecting cover according to FIG. 2. If desired, a deflector similar to the one being arranged at the first wall element 13 can be arranged also at the second wall element 14. Of course, the protecting cover 11 according to FIG. 3 can be used in a drying section according to FIG. 2 which has a solid press roll, for enclosing a portion of this press roll in the same fashion in order to utilize the advantage of obtaining an air barrier in the gap.

Figure 4:
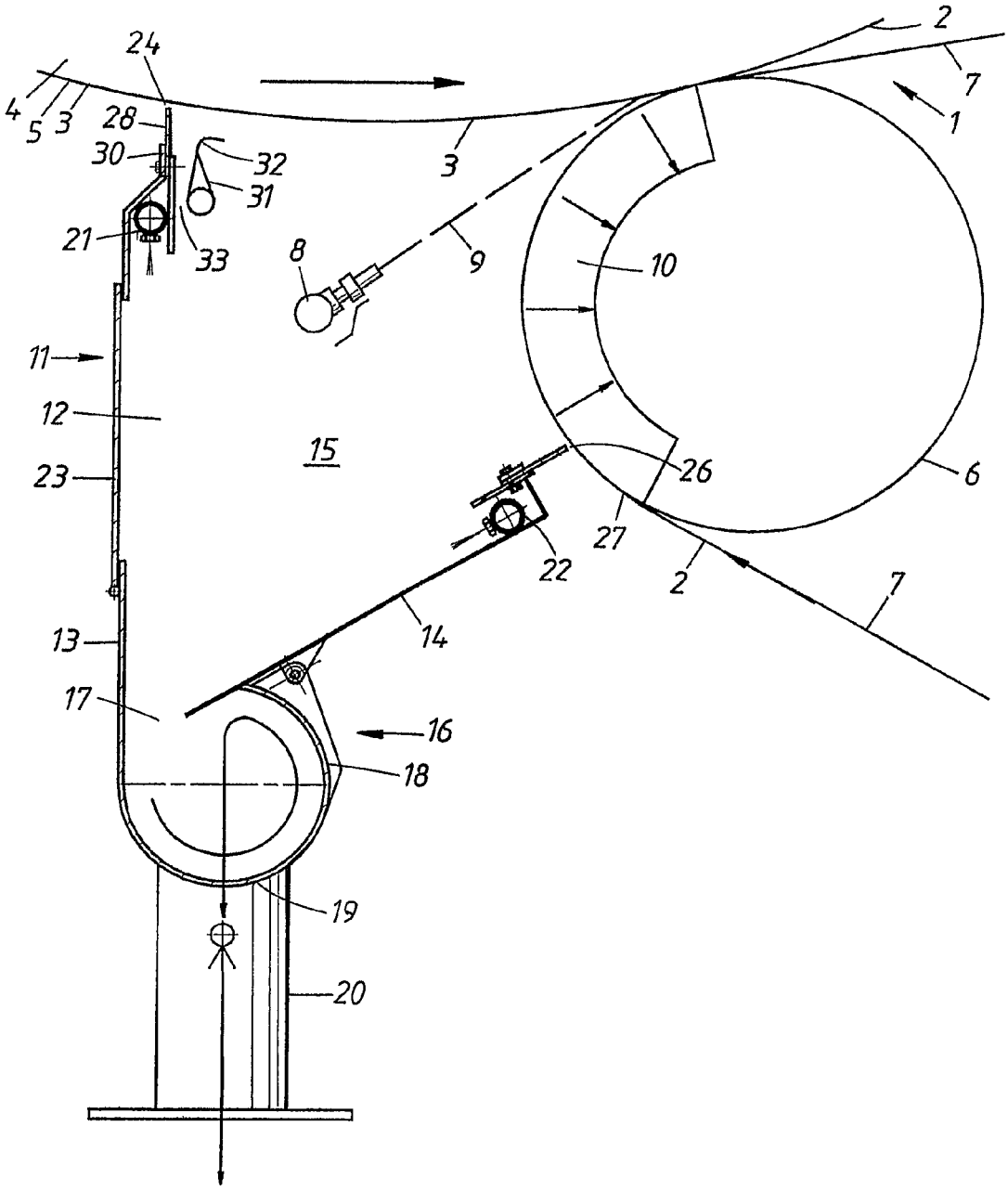

In FIG. 3, the spraying equipment 8 is arranged for emitting a jet 9 of spraying liquid straight towards the moving surface 3, whereas, in FIG. 4, it is arranged for emitting a jet 9 of spraying liquid into the nip between the drying cylinder 4 and the suction press roll 6 obliquely towards the moving surface 3. The protecting cover 11 according to FIG. 4 corresponds to the one in FIG. 3.

Figure 5:
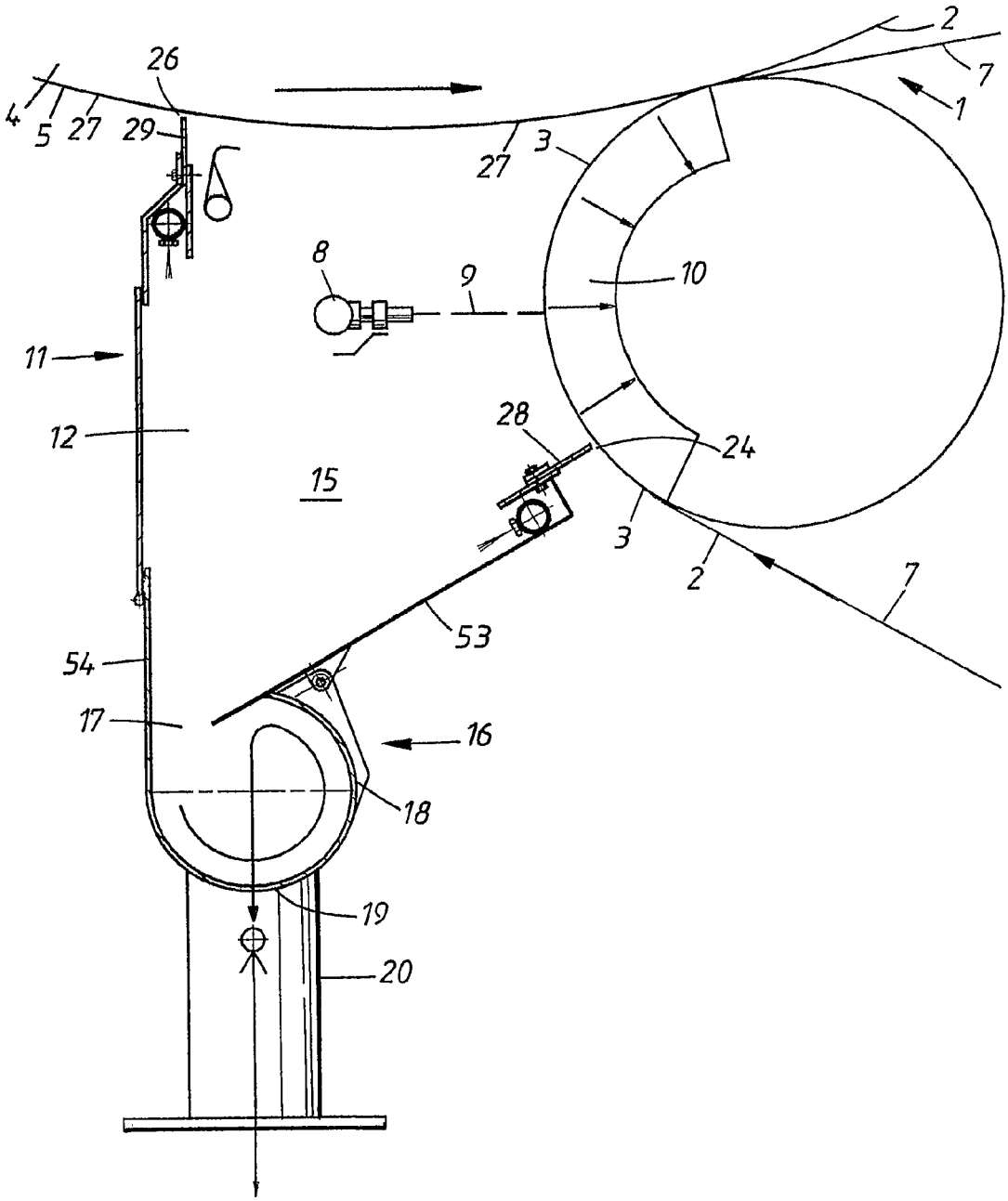

In FIG. 5, the spraying equipment is arranged for emitting a jet 9 of spraying liquid towards the web 2 which in this case forms a first moving surface 3, whereas the shell surface 5 of the drying cylinder 4 forms a second moving surface 27. A coating on the web 2 obtained in this way is then transferred to the shell surface 5, when the web 2 comes into contact with the shell surface 5. From a structural point of view, the protecting covers in FIGS. 3 and 5 are similar, but the wall elements as well as the two moving surfaces have turned functions. Thus, the protecting cover 11 has first and second wall elements 53, 54, wherein the first wall element 53 is located upstream the application zone, as seen in relation to the direction of movement of the first moving surface 3 which thus is formed by the web 2, onto which surface 3 the treatment medium is applied, and defines a machine-wide, first gap 24 between itself and the first moving surface 3, whereas the second wall element 54 defines a machine-wide, second gap 26 between itself and the second moving surface 27 which thus is formed by the shell surface 5.

Figure 7:
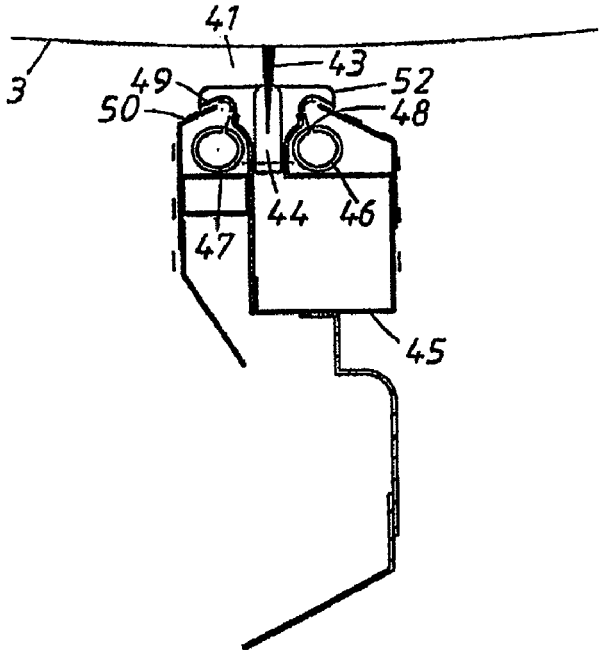
FIG. 7 shows a portion of the protecting device according to FIG. 6.
Figure 6:
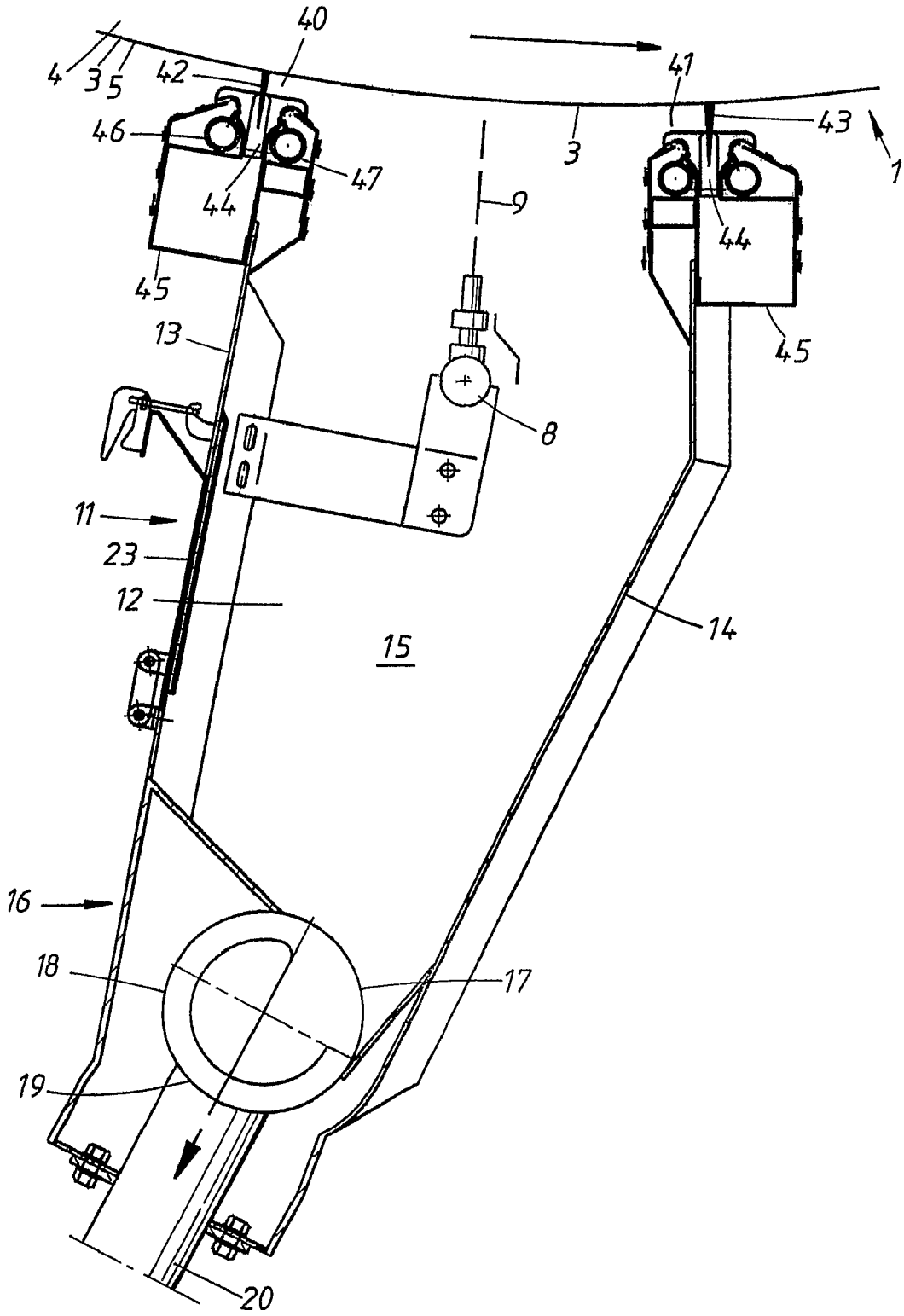
FIG. 6 shows schematically portions of a section of a paper machine being equipped with a protecting device according to a third embodiment of the invention.

FIG. 6 shows a protecting device which substantially, with the exception of the sealing arrangement per se, is similar to the one in FIG. 2. The same or similar structural elements and components have therefore been given the same reference numerals as in FIG. 2. The wall elements 13, 14 of the protecting cover and the moving surface 3 define therebetween machine-wide, first and second gaps 40, 41, the sizes of which being not critical as in the previously described embodiments, since the sealing arrangement in this case comprises a machine-wide fluid sealing device for each gap 40, 41 and wall element 13, 14, said fluid sealing device comprises at least one fluid jet 42, 43 and at least one nozzle 44 (see FIG. 7) which is arranged in a holder 45 of the wall element 13, 14. In the embodiment shown the nozzle 44 is arranged for emitting a fluid jet 42, 43 perpendicularly or substantially perpendicularly to the moving surface 3. The holder 45 is also carrying two machine-wide liquid distributing pipes 46, 47 which are arranged on either side of the nozzle 44 and each having a longitudinal slit 48 for discharging a liquid layer, a first folded guide plate 49 being arranged in connection with said slit 48. A further second folded guide plate 50 extends on the inside and outside, respectively, of the holder 45 from the inside of the first guide plate 49 in order to receive the discharged and deflected liquid layer via a gap defined by the two guide plates 49, 50, said deflected liquid layer following along the surface of the first guide plate 49 while forming a liquid film covering the second guide plate 50 so that contaminants are prevented from attaching to and accumulating onto the guide plate 50 which thereby is kept clean. The above-mentioned elements 46, 47, 48, 49, 50 constitute a cleaning system which efficiently prevents the deposition of contaminants, said deposits otherwise could disturb the function of the fluid sealing device. Each nozzle 44 is protected by a cover 52 having an opening for the fluid jet 42, 43. Each fluid jet 42, 43 is adjusted and regulated so that it is acting with such a force that it creates a barrier inside the gap 40, 41 that prevents air from flowing through the gap 40, 41. The fluid jet is acting all the way to the moving surface 3 and becomes impenetrable or almost impenetrable for the air streams occurring along the moving surface 3 and which can contain contaminants. A gas, usually air, or a liquid, usually water, can be used as a fluid. When air is used, a portion of the air jet 42, 43 will flow into the space in a controllable manner in order to be used as capture air for the residues of spraying liquid and then continuously be sucked out through the evacuating system. When a liquid is used as a fluid such a capture air has to be supplied directly to the protecting cover, suitably in connection to one or both gaps 40, 41, from an external source which then suitably is free from contaminants.

In the embodiment according to FIG. 6, conveniently the spraying equipment 8 is arranged pivotally in order to be rotated into a position in which the jet 9 of spraying liquid is directed away from the moving surface 3 so that it hits the inside of the wall element 14 instead when a temporary interruption of the application onto the moving surface 3 is desired.

The invention can be applied to a spraying equipment in any type of paper or board machine being operated at a high speed, and in any section where a spraying equipment and its surroundings should be protected. It is particularly applicable for a spraying equipment in a soft paper machine and especially in such a machine for the manufacture of creped soft paper. The moving surface 3, which is to be treated with a chemical-containing spraying liquid, can be a shell surface of a roll, e.g. a drying cylinder, as has been described, or a paper web, as has been described, or a board web, said paper or board web being supported by a clothing or a roll or by a clothing and a roll.

The two side wall elements 15 of the protecting cover are sealed in a suitable way at adjacent structural elements in order to avoid leakage to the sides.

The invention is particularly applicable to high speed machines, where the moving surface has a speed of at least about 1200 m/min, e.g. 1200-2500 m/min, whereby boundary layer air flows are created along the moving surface.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A device for protecting spraying equipment in a paper or board machine, the spraying equipment being mounted adjacent to a first moving surface of the machine for applying a treatment medium thereon within a machine-wide application zone having opposing upstream and downstream sides, said device comprising:

a machine-wide protecting cover defining a single-chamber internal space configured to enclose the spraying equipment and defining an opening directed toward the first moving surface, the opening extending over the application zone, said protecting cover comprising:

first and second machine-wide wall elements extending transversely to the machine direction along the upstream and downstream sides of the application zone, respectively, each of the first and second wall elements being spaced apart from the first moving surface so as to define respective machine-wide first and second gaps therebetween;

a sealing arrangement comprising at least one machine-wide mechanical sealing device, the sealing device being:

operably engaged with the first and second gaps;

configured with respect to the first and second gaps to selectively restrict passage of at least a portion of a boundary layer air flow created adjacent the first moving surface and contaminants contained therein through at least one of the first and second gaps and into the internal space; and replaceable with a replacement sealing device, the replacement sealing device being configured to one of maintain, decrease and increase a size of at least one of the first and second gaps;

a capture air supply system comprising the at least one machine-wide mechanical sealing device operably engaged with the first gap and configured to supply to the internal space at least a portion of a radial inner layer of the boundary layer air flow as capture air for capturing contaminants contained within the internal space; and an evacuating system operably engaged with the internal space and configured to selectively and continuously evacuate the capture air with contaminants therefrom.

2. The device according to claim 1, wherein the evacuating system comprises an outlet portion formed by a portion of the protecting cover, the outlet portion being disposed outward of the spraying equipment from the first moving surface.

3. The device according to claim 2, wherein the protecting cover further comprises opposing side walls each extending between the first and second end walls, and wherein the outlet portion comprises a machine-wide outlet housing having opposing ends, the outlet housing communicating with the internal space via a machine-wide outlet gap extending between the side walls and having an outlet opening about one of the opposing ends.

4. The device according to claim 1, wherein the sealing device is adjustable to vary a size of the respective gap.

5. The device according to claim 1, wherein the sealing device comprises a sealing strip.

6. The device according to claim 1, wherein the first gap has a size between about 1 mm and about 75 mm.

7. The device according to claim 6, wherein the first gap has a size between about 25 mm and about 30 mm.

8. The device according to claim 1, wherein the second gap has a size between about 1 mm and about 50 mm.

9. The device according to claim 8, wherein the second gap has a size between about 25 mm and about 30 mm.

10. The device according to claim 1, further comprising a machine-wide spray pipe configured to emit at least one liquid jet along an inner surface of each wall element so as to remove contaminants therefrom and to eject the capture air with contaminants from the internal space.

11. The device according claim 10, further comprising a machine-wide deflector operably engaged with the inner surface of the first wall element between the first gap and the spray pipe the deflector cooperating with the first wall element to defining a channel, wherein the ejection of the capture air with contaminants by the at least one liquid jet emitted by the spray pipe produces a negative pressure acting on the channel such that at least a portion of the capture air entering the internal space through the first gap and contaminants are pulled through the channel toward the evacuating system.

12. The device according claim 10, further comprising a machine-wide deflector operably engaged with the inner surface of the first wall element between the first gap and the spray pipe the deflector cooperating with the first wall element to defining a channel, wherein the ejection of the capture air with contaminants by the at least one liquid jet emitted by the spray pipe produces a negative pressure acting on the channel such that at least a portion of the capture air entering the internal space through the first gap and contaminants are pulled through the channel toward the evacuating system.

13. A method of protecting spraying in a paper or board machine, the spraying equipment being mounted adjacent to a first moving surface of the machine for applying a treatment medium thereon within a machine-wide application zone having opposing upstream and downstream sides, wherein a machine-wide protecting cover defining a single-chamber internal space is configured to enclose the spraying equipment and defines an opening directed toward the first moving surface, with the opening extending over the application zone, and wherein first and second machine-wide wall elements extend transversely to the machine direction along the upstream and downstream sides of the application zone, respectively, such that the first wall element is spaced apart from the first moving to define a machine-wide first gap therebetween and such that second wall element is spaced apart from one of the first moving surface and a second moving surface to define a machine-wide second gap therebetween, said method comprising:

selectively restricting passage of air and contaminants through the first and second gaps into the internal space enclosing the spraying equipment with a sealing arrangement configured with respect to the first and second gaps;

supplying capture air with a capture air supply system to the internal space for the capture air to capture contaminants in the internal space; and selectively and continuously evacuating the capture air with contaminants from the internal space with an evacuating system operably engaged therewith.

14. The method according to claim 13, further comprising diverting the capture air with contaminants toward the evacuating system away from the application zone.

15. The method according to claim 13, wherein selectively restricting passage of air and contaminants further comprises substantially sealing the second gap between the second wall element and the first moving surface with the sealing arrangement, without the sealing arrangement contacting with the first moving surface, so as to minimize an amount of the capture air and contaminants passing therethrough.

16. The method according to claim 13, wherein the second gap is defined by the second wall element and the second moving surface, the second moving surface being configured to engage the first moving surface within the internal space following downstream side of the application zone, and wherein selectively restricting passage of air and contaminants further comprises substantially sealing the second gap between the second wall element and the second moving surface with the sealing arrangement.

17. The method according to claim 13, wherein selectively restricting passage of air and contaminants further comprises selectively restricting passage of air and contaminants through the first and second gaps into the internal space enclosing the spraying equipment with a sealing arrangement comprising a mechanical sealing device, the mechanical sealing device being adjustable so as to vary a size of the respective gap, and wherein supplying capture air with a capture air supply system further comprises adjusting the size of the first gap via the mechanical sealing device so as to supply a required amount of the capture air to the internal space.

18. The method according to 13, wherein the sealing arrangement comprises a fluid sealing device operably engaged with each gap, and wherein selectively restricting passage of air and contaminants further comprises selectively restricting passage of air and contaminants through the first and second gaps into the internal space enclosing the spraying equipment with at least one fluid jet emitted by the fluid sealing device, the at least one fluid jet being configured to form a barrier, whereby the barrier is substantially impenetrable to air and contaminants.

19. The method according to claim 18, wherein the at least one fluid jet comprises a gas jet, and wherein supplying capture air with a capture air supply system further comprises directing at least a portion of the air emitted from the gas jet to the internal space to supply a required amount of capture air.

20. The method according to claim 19, wherein the gas jet comprises an air jet.

21. The method according to claim 18, the at least one fluid jet comprises a liquid jet, and wherein supplying capture air with a capture air supply system further comprises supplying a required amount of capture air to the internal space with a compressed air source in communication therewith.

22. The method according to claim 21, the liquid jet comprises a water jet.

23. The method according to 13, wherein the paper or board machine is operated at a speed of at least about 1200 m/min.

24. A device for protecting spraying equipment in a paper or board machine, the spraying equipment being mounted adjacent to a first and a second moving surface of the machine for applying a treatment medium thereon within a machine-wide application zone having opposing upstream and downstream sides, said device comprising:

a machine-wide protecting cover defining a single-chamber internal space configured to enclose the spraying equipment and defining an opening directed toward the first moving surface, the opening extending over the application zone, said protecting cover comprising:

first and second machine-wide wall elements extending transversely to the machine direction along the upstream and downstream sides of the application zone, respectively, the first wall element being spaced apart from the first moving surface so as to define a machine-wide first gap therebetween, the second wall element being spaced apart from the second moving surface so as to define a machine-wide second gap therebetween;

a sealing arrangement comprising at least one machine-wide mechanical sealing device operably engaged with the first and second gaps and configured with respect to the first and second gaps to selectively restrict passage of at least a portion of a boundary layer air flow created adjacent at least the first moving surface and contaminants contained therein through at least one of the first and second gaps and into the internal space;

a capture air supply system comprising the at least one machine-wide mechanical sealing device operably engaged with the first and second gaps and configured to supply to the internal space at least a portion of a radial inner layer of the boundary layer air flow as capture air for capturing contaminants contained within the internal space; and an evacuating system operably engaged with the internal space and configured to selectively and continuously evacuate the capture air with contaminants therefrom.

25. The device according to claim 24, wherein the second gap has a size between about 1 mm and about 50 mm.

26. The device according to claim 25, wherein the second gap has a size between about 25 mm and about 30 mm.

27. A device for protecting spraying equipment in a paper or board machine, the spraying equipment being mounted adjacent to a first moving surface of the machine for applying a treatment medium thereon within a machine-wide application zone having opposing upstream and downstream sides, said device comprising:

a machine-wide protecting cover defining a single-chamber internal space configured to enclose the spraying equipment and defining an opening directed toward the first moving surface, the opening extending over the application zone, said protecting cover comprising:

first and second machine-wide wall elements extending transversely to the machine direction along the upstream and downstream sides of the application zone, respectively, each of the first and second wall elements being spaced apart from the first moving surface so as to define respective machine-wide first and second gaps therebetween;

a sealing arrangement comprising at least one machine-wide fluid sealing device operably engaged with the first and second gaps and configured with respect to the first and second gaps to selectively restrict passage of air and contaminants through at least one of the first and second gaps and into the internal space;

a capture air supply system configured to supply capture air to the internal space for capturing contaminants therein; and an evacuating system operably engaged with the internal space and configured to selectively and continuously evacuate the capture air with contaminants therefrom.

28. The device according to claim 27, wherein the fluid sealing device comprises at least one nozzle operably engaged with at least one of the first and second wall elements, each of the at least one nozzle being configured to emit a fluid jet toward the first moving surface.

29. The device according to claim 28, wherein the fluid jet emitted by each of the at least one nozzle is configured to form a barrier between the respective at least one nozzle and the first moving surface, whereby the barrier is substantially impenetrable to air and contaminants.

30. The device according to claim 28, wherein the fluid jet comprises a gas jet, and the capture air supply system comprises the gas jet, wherein at least a portion of the gas emitted from the gas jet is directed to the internal space to supply the required amount of capture air.

31. The device according to claim 30, wherein the gas jet comprises an air jet.

32. The device according to claim 28, wherein the fluid jet comprises a liquid jet, and the capture air supply system comprises a compressed air source in communication with the internal space about at least one of the gaps so as to supply the required amount of capture air without interrupting the liquid jet.

33. The device according to claim 32, wherein the liquid jet comprises a water jet.

34. The device according to claim 28, wherein each wall element comprises a holder for mounting the at least one nozzle thereto, and a liquid distributing pipe mounted to the holder on opposing sides of the at least one nozzle, each liquid distributing pipe being configured to emit a guiding liquid film, the guiding liquid film being directed by a guide plate to clean the holder of contaminants.

35. A device for protecting spraying equipment in a paper or board machine, the spraying equipment being mounted adjacent to a first moving surface of the machine for applying a treatment medium thereon within a machine-wide application zone having opposing upstream and downstream sides, said device comprising:

a machine-wide protecting cover defining a single-chamber internal space configured to enclose the spraying equipment and defining an opening directed toward the first moving surface, the opening extending over the application zone, said protecting cover comprising:

first and second machine-wide wall elements extending transversely to the machine direction along the upstream and downstream sides of the application zone, respectively, each of the first and second wall elements being spaced apart from the first moving surface so as to define respective machine-wide first and second gaps therebetween;

a sealing arrangement comprising at least one machine-wide sealing strip operably engaged with the first and second gaps and configured with respect to the first and second gaps to selectively restrict passage of at least a portion of a boundary layer air flow created adjacent the first moving surface and contaminants contained therein through at least one of the first and second gaps and into the internal space;

a capture air supply system comprising the at least one machine-wide sealing strip operably engaged with the first gap and configured to supply to the internal space at least a portion of a radial inner layer of the boundary layer air flow as capture air for capturing contaminants contained within the internal space; and an evacuating system operably engaged with the internal space and configured to selectively and continuously evacuate the capture air with contaminants therefrom.

36. A device for protecting spraying equipment in a paper or board machine, the spraying equipment being mounted adjacent to a first moving surface of the machine for applying a treatment medium thereon within a machine-wide application zone having opposing upstream and downstream sides, said device comprising:

a machine-wide protecting cover defining a single-chamber internal space configured to enclose the spraying equipment and defining an opening directed toward the first moving surface, the opening extending over the application zone, said protecting cover comprising:

first and second machine-wide wall elements extending transversely to the machine direction along the upstream and downstream sides of the application zone, respectively, each of the first and second wall elements being spaced apart from the first moving surface so as to define respective machine-wide first and second gaps therebetween;

a sealing arrangement comprising at least one machine-wide mechanical sealing device operably engaged with the first and second gaps and configured with respect to the first and second gaps to selectively restrict passage of at least a portion of a boundary layer air flow created adjacent the first moving surface and contaminants contained therein through at least one of the first and second gaps and into the internal space;

a capture air supply system comprising the at least one machine-wide mechanical sealing device operably engaged with the first gap and configured to supply to the internal space at least a portion of a radial inner layer of the boundary layer air flow as capture air for capturing contaminants contained within the internal space;

an evacuating system operably engaged with the internal space and configured to selectively and continuously evacuate the capture air with contaminants therefrom; and a machine-wide spray pipe configured to emit at least one liquid jet along an inner surface of each wall element so as to remove contaminants therefrom and to eject the capture air with contaminants from the internal space.

37. A device for protecting spraying equipment in a paper or board machine, the spraying equipment being mounted adjacent to a first and a second moving surface of the machine for applying a treatment medium thereon within a machine-wide application zone having opposing upstream and downstream sides, said device comprising:

a machine-wide protecting cover defining a single-chamber internal space configured to enclose the spraying equipment and defining an opening directed at least partially toward the first moving surface, the opening extending over the application zone, said protecting cover comprising:

first and second machine-wide wall elements extending transversely to the machine direction along the upstream and downstream sides of the application zone, respectively, the first wall element being spaced apart from the first moving surface so as to define a machine-wide first gap therebetween, the second wall element being spaced apart from the second moving surface so as to define a machine-wide second gap therebetween;

a sealing arrangement comprising at least one machine-wide mechanical sealing device operably engaged with the first and second gaps and configured with respect to the first and second gaps to selectively restrict passage of at least a portion of a boundary layer air flow created adjacent at least the first moving surface and contaminants contained therein through at least one of the first and second gaps and into the internal space;

a capture air supply system comprising the at least one machine-wide mechanical sealing device operably engaged with the first gap and configured to supply to the internal space at least a portion of a radial inner layer of the boundary layer air flow as capture air for capturing contaminants contained within the internal space; and an evacuating system operably engaged with the internal space and configured to selectively and continuously evacuate the capture air with contaminants therefrom.

* * * * *